US009471075B2

(12) United States Patent
Hu et al.

(10) Patent No.: US 9,471,075 B2
(45) Date of Patent: Oct. 18, 2016

(54) COMPENSATION MODULE AND VOLTAGE REGULATOR

(71) Applicant: NOVATEK Microelectronics Corp., Hsin-Chu (TW)

(72) Inventors: Min-Hung Hu, Hsinchu (TW); Pin-Han Su, Taichung (TW); Chun-Wei Huang, Hsinchu County (TW); Chen-Tsung Wu, Kaohsiung (TW); Chiu-Huang Huang, Hsinchu County (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 281 days.

(21) Appl. No.: 14/228,235

(22) Filed: Mar. 27, 2014

(65) Prior Publication Data

US 2014/0306676 A1 Oct. 16, 2014

(30) Foreign Application Priority Data

Apr. 15, 2013 (TW) ..... 102113283 A

(51) Int. Cl.
*G05F 1/56* (2006.01)
*G05F 1/575* (2006.01)

(52) U.S. Cl.
CPC ..... *G05F 1/575* (2013.01); *G05F 1/56* (2013.01)

(58) Field of Classification Search
CPC ..... G05F 1/56; G05F 1/563; G05F 1/575
See application file for complete search history.

(56) References Cited

U.S. PATENT DOCUMENTS

| | | | | |
|---|---|---|---|---|
| 6,518,737 | B1 | 2/2003 | Stanescu | |
| 6,977,490 | B1 * | 12/2005 | Zhang | G05F 1/575 323/280 |
| 8,054,055 | B2 * | 11/2011 | Mandal | G05F 1/565 323/280 |
| 8,779,736 | B2 * | 7/2014 | Gao | G05F 1/575 323/280 |
| 2011/0121800 | A1 | 5/2011 | Drebinger | |
| 2013/0241505 | A1 * | 9/2013 | Chang | G05F 1/575 323/282 |
| 2013/0241649 | A1 * | 9/2013 | Fort | G05F 1/575 330/253 |

FOREIGN PATENT DOCUMENTS

| | | |
|---|---|---|
| CN | 101464699 A | 6/2009 |
| CN | 102566641 A | 7/2012 |
| TW | 471220 | 1/2002 |
| TW | 200634467 | 10/2006 |
| TW | 200703884 | 1/2007 |

* cited by examiner

*Primary Examiner* — Matthew Nguyen
(74) *Attorney, Agent, or Firm* — Winston Hsu; Scott Margo

(57) ABSTRACT

A compensation module for a voltage regulation device having a gain stage, an output stage and a miller compensation module includes a low-output-impedance non-inverting amplifier unit coupled to a gain output of the gain stage and an output-stage input of the output stage.

15 Claims, 7 Drawing Sheets

COMPENSATION MODULE AND VOLTAGE REGULATOR

BACKGROUND OF THE INVENTION

1. Field of the Invention

The present application relates to a compensation module and voltage regulator thereof, and more particularly, to a compensation module and voltage regulator thereof capable of enhancing the stability and the noise immunity.

2. Description of the Prior Art

In an integrated circuit, a voltage regulator is a negative feedback circuit for generating accurate and stable voltage. The voltage outputted by the voltage regulator is utilized as a reference voltage or a power for another circuit in the integrated circuit, generally. When designing the voltage regulator, the stability of the voltage regulator can be improved via frequency compensating and the power noise interference of the system power can be reduced via the negative feedback feature to improve a power supply rejection ration (PSRR).

Please refer to FIG. 1, which is a schematic diagram of a conventional miller compensation structure 10 utilized in a voltage regulator. As shown in FIG. 1, the miller compensation structure 10 comprises N-type transistors MN1-MN3, P-type transistors MP1, MP2, a current source IB and a miller capacitor $C_{M1}$. The combination of the N-type transistors MN2, MN3 and the P-type transistors MP1, MP2 is an output stage of a front-stage circuit. The miller capacitor CM1 is coupled between a node MN1_G and an output end OUT (i.e. between a gate and a drain of the N-type transistor MN1). Through a gain GainMN1 generated by the N-type transistor MN1, the miller capacitor $C_{M1}$ equals an enlarged capacitor configured at the node MN1_G, wherein the capacitance of the enlarged capacitor is a product of a capacitance of the miller capacitor $C_{M1}$ and the gain GainMN1. The main pole of the voltage regulator shown in FIG. 1 moves toward a low-frequency range, therefore, and the stability of the voltage regulator is improved. However, power noise in the miller compensation structure 10 is transmitted to the output end OUT through a path of the P-type transistors MP1, MP2 and the miller capacitor CM1, resulting in the power supply rejection ratio of the voltage regulator is degraded in the high-frequency range.

Please refer to FIG. 2, which is a schematic diagram of a conventional cascode miller compensation structure 20 utilized in a voltage regulator. Similar to the miller compensation structure 10, the cascode miller compensation structure 20 comprises N-type transistors MN1-MN3, P-type transistors MP1, MP2, a current source IB and a miller capacitor $C_{M2}$ and a combination of the N-type transistors MN2, MN3 and the P-type transistors MP1, MP2 is an output stage of a front-stage circuit. Different from the miller compensation structure 10, the miller capacitor $C_{M2}$ of the cascode miller compensation structure 20 is coupled between a node X and the output end OUT. Via a high impedance between the node MN1_G and the node X, the power noise cannot be transmitted to the output end OUT through the miller capacitor $C_{M2}$ and the power supply rejection ratio of the voltage regulator is accordingly improved. When the miller capacitance CM2 is coupled to the node X, parasitic zeros Z1, Z2 are accordingly generated, however. The parasitic zeros Z1, Z2 can be expressed as:

$$Z1 \cong -\frac{gm_{MN2}}{C_X} \cdot Z2 \cong \frac{gm_{MN1}C_X}{C_{OTA}C_{M2} + C_{GD}C_X + C_{M2}C_{GD}}$$

Where $C_X$ is a parasitic capacitance of the node X, $$\frac{1}{gm_{MN2}}$$

is an equivalent resistance of the node X, $gm_{MN1}$ is a trans-conductance of the N-type transistor MN1, $C_{GD}$ is a parasitic capacitor between the gate and the drain of the N-type transistor MN1, and the $C_{OTA}$ is an output capacitance of the front stage circuit. At a high frequency range, the parasitic zeros Z1, Z2 raise the gain of the voltage regulator, such that the stable time of an open-loop step response of the voltage regulator is increased and the stability of the voltage regulator is affected.

Besides, the prior art also provides a method of using a current mirror to improve the power supply rejection ration of the voltage regulator. Please refer to FIG. 3, which is a schematic diagram of a conventional voltage regulator 30. As shown in FIG. 3, the voltage regulator 30 adds a current mirror between a gain stage OTA and the P-type transistor MP2, for allowing the power noise to be transmitted to the node MP1_G through the P-type transistor MP2. In such a condition, the node MP1_G synchronizes with the power VDD and the power noise transmitted to the output end OUT can be suppressed. Since the relationship between the output of the gain stage OTA and the output of the P-type transistor MP1 is non-inverting, the voltage regulator 30 cannot use miller compensation, however. Thus, the voltage regulator 30 only can use dominant pole compensation for increasing the stability. In other words, the voltage regulator 30 increases the stability via configuring a capacitance $C_L$ with a significant capacitance at the output end OUT. The layout area of the voltage regulator 30 is substantially increased when adopting the dominant pole compensation, resulting in rising manufacture cost. Besides, the power noise in the high frequency range still transmits to the output end OUT through a parasitic capacitor $C_{SD}$ of the P-type transistor MP1 and decreases the power supply rejection ratio of the voltage regulator 30. As can be seen from the above, the prior art is needed to be improved.

SUMMARY OF THE INVENTION

Therefore, the present application provides a compensation module with low output impedance and non-inverting gain and voltage regulator thereof to increase the stability and the power supply rejection ration of the voltage regulator.

The present application discloses a compensation module for a voltage regulation device comprising a gain stage, an output stage and a miller compensation module. The compensation module comprises a low-output-impedance non-inverting amplifier unit coupled to a gain output of the gain stage and an output-stage input of the output stage.

The present application further discloses a voltage regulation device, comprising a gain stage; an output stage; a miller compensation module, coupled between an output-stage output end of the output stage and the gain stage; and a compensation module, comprising a low-output-impedance non-inverting amplifier unit coupled to a gain output of the gain stage and an output-stage input of the output stage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
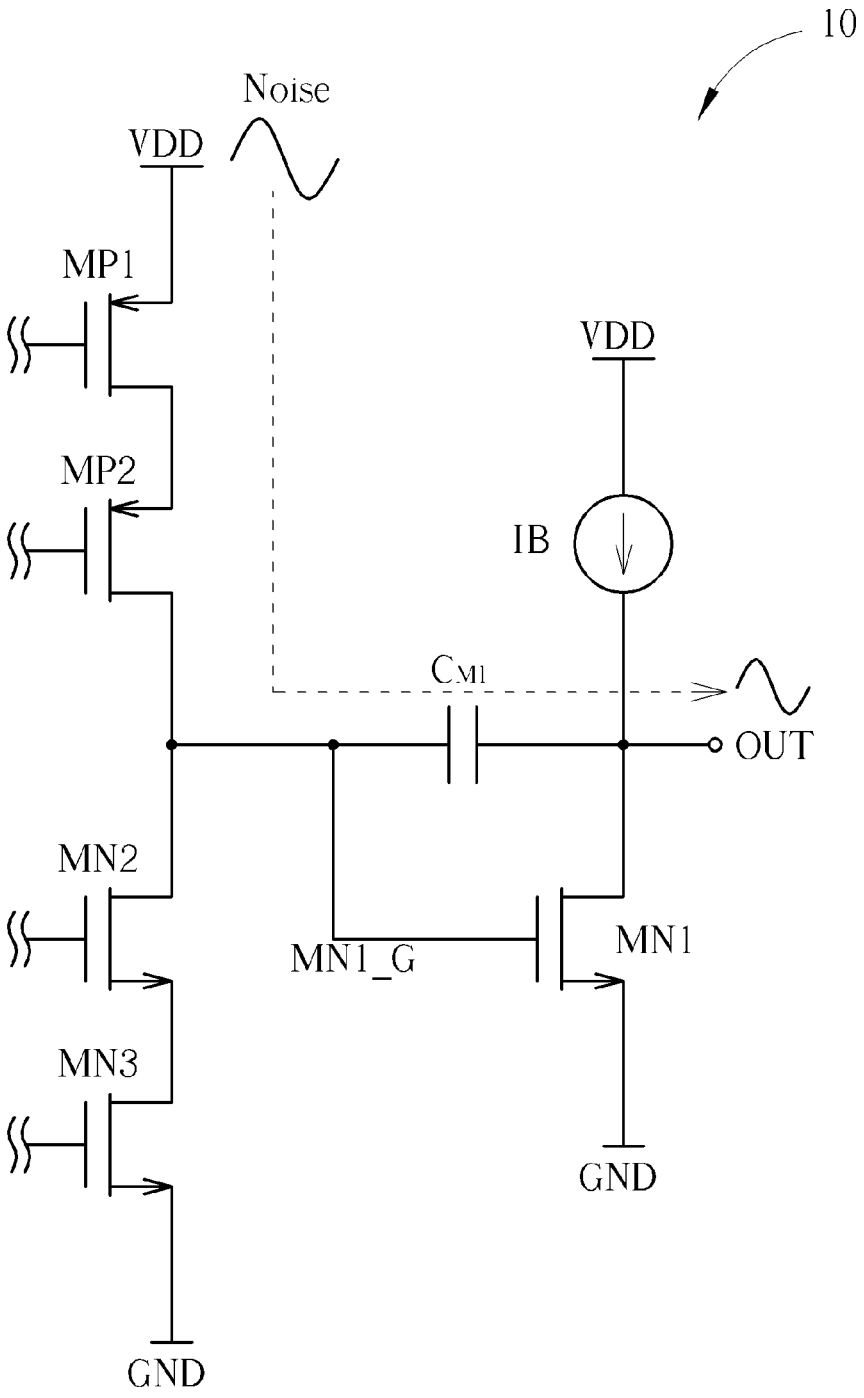
FIG. 1 PRIOR ART
FIG. 1 is a schematic diagram of a conventional miller compensation structure.
Figure 2:
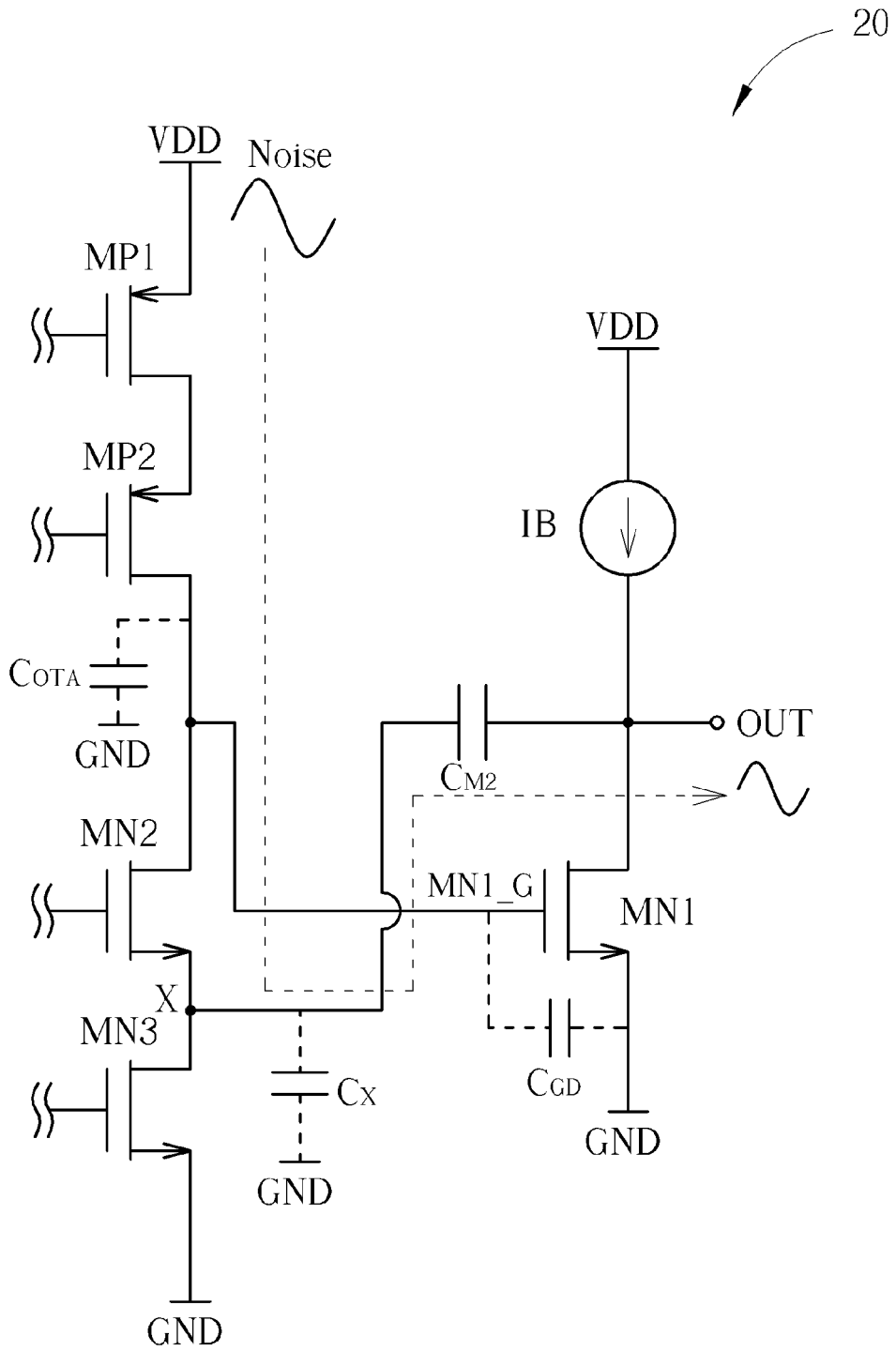
FIG. 2 PRIOR ART
FIG. 2 is a schematic diagram of a conventional cascode miller compensation structure.
Figure 3:
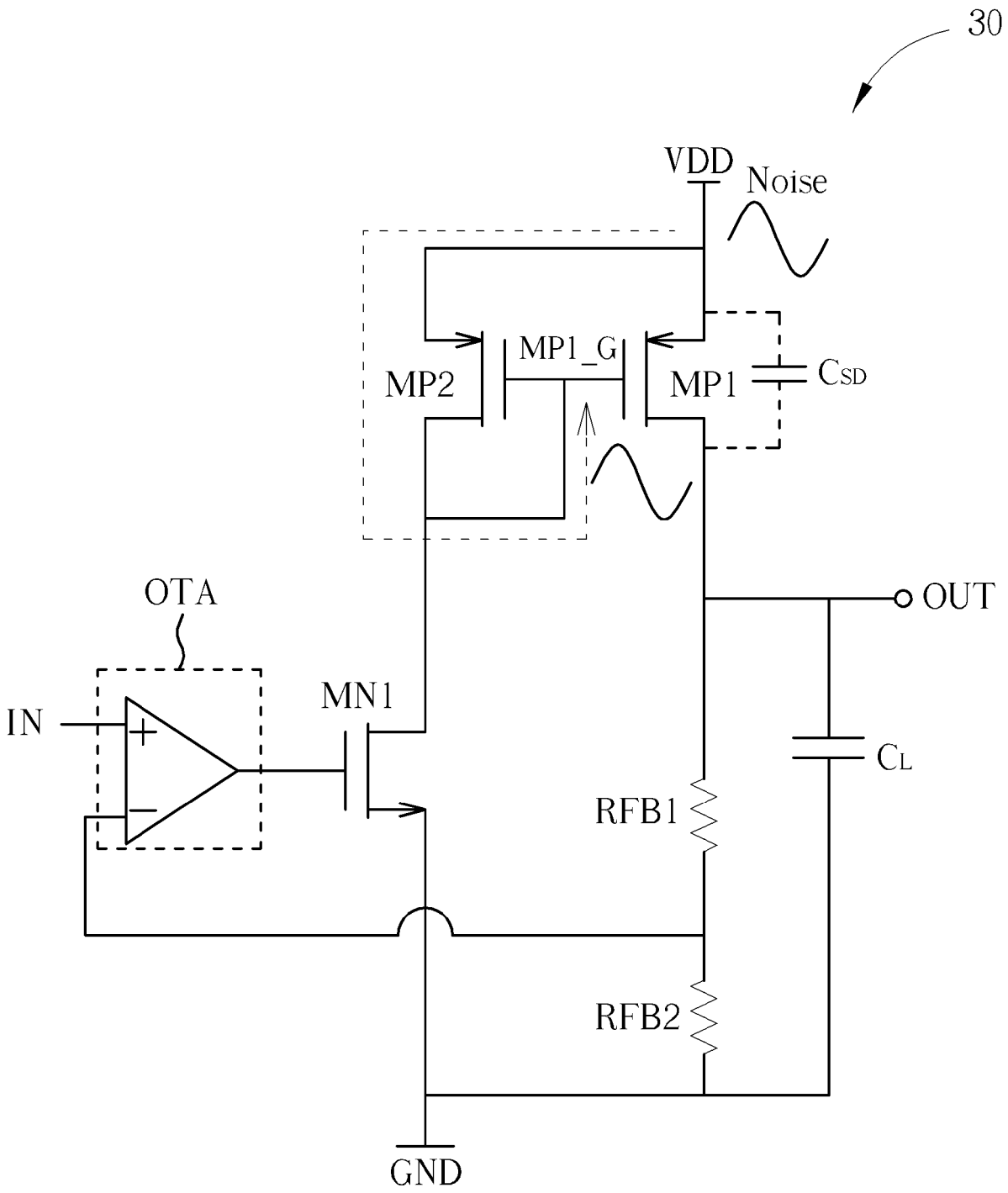
FIG. 3 PRIOR ART
FIG. 3 is a schematic diagram of a conventional voltage regulator.
Figure 4:
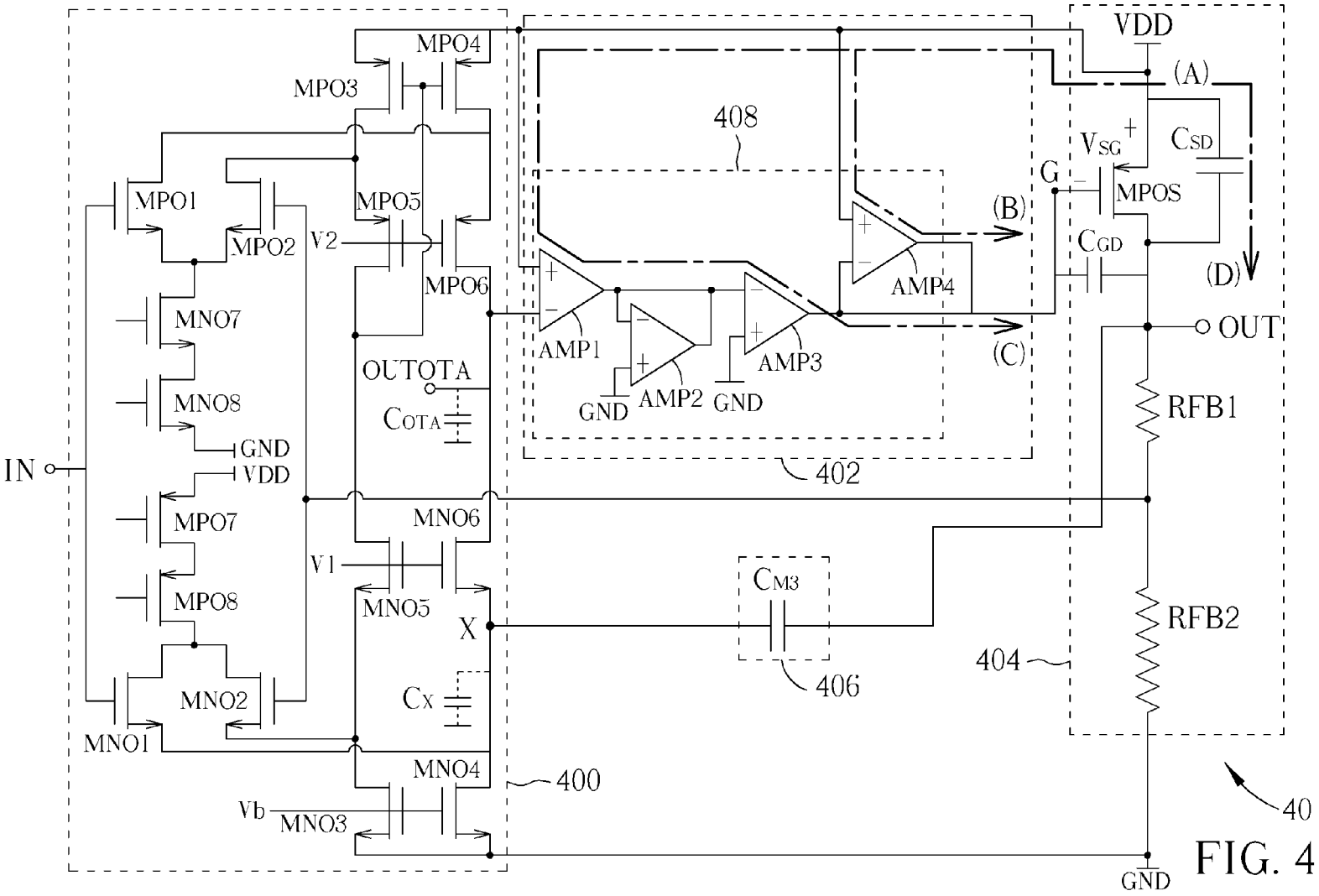
FIG. 4 is a schematic diagram of a voltage regulator according to an embodiment of the present invention.

Please refer to FIG. 4, which is a schematic diagram of a voltage regulator according to an embodiment of the present invention. The voltage regulator 40 is utilized for generating a steady output voltage VOUT at an output end OUT according to an input voltage VIN of an input end IN. As shown in FIG. 4, the voltage regulator 40 comprises a gain stage 400, a compensation module 402, an output stage 404 and a miller compensation module 406. The gain stage 400 is utilized for generating an output voltage VOTA at an output end OUTOTA according to the input voltage VIN. The compensation module 402 is coupled to the gain stage 400 and comprises a low-output-impedance non-inverting amplifier unit 408. The compensation module 402 is utilized for outputting a voltage VG at a node G according to the voltage VOTA. The output stage 404 is coupled to the gain stage 400 and the compensation module 402 for generating the output voltage VOUT according to the voltage VG and generating a feedback voltage VFB according to the output voltage VOUT. The miller compensation module 406 is coupled between the gain stage 400 and the output stage 404, for compensating the unit gain bandwidth of the voltage regulator 40. Please note that, since the compensation module 40 features low-output-impedance, the parasitic zeros generated by a combination of parasitic capacitors of the compensation module 402 and the output stage 404 move to high-frequency range and can be ignored. As a result, the parasitic zeros do not affect the performance of the voltage regulator. Besides, since the gain of the compensation module 402 is non-inverting, a relationship between the output end OUTOTA and the output end OUT remains inverting. In such a condition, the voltage regulator 40 can use the miller compensation module 406 to achieve the miller compensation, such that a bandwidth of the voltage regulator 40 can be effectively adjusted without significantly increasing a chip area of the voltage regulator 40.

In detail, the gain stage 400 is an amplifier circuit that includes P-type transistors MPO1-MPO8, the output stage 404 comprises a common source amplifier that includes a P-type transistor MPOS and voltage-dividing unit that includes feedback resistors RFB1, RFB2, and the miller compensation module 406 comprises a miller capacitor $C_{M3}$ in this embodiment. The operational principles of the gain stage 400, output stage 404 and miller compensation module 406 should be known by those with ordinary skill in the art, and are not described herein for brevity. According to different applications, the gain stage 400, the output stage 404 and the miller compensation module 406 can be modified and are not limited herein.

The low-output-impedance non-inverting amplifier unit 408 comprises amplifiers AMP1-AMP4, wherein trans-conductance of the amplifiers AMP1-AMP4 are gm1-gm4, respectively. The amplifier AMP1 comprises a positive input end coupled to a power VDD and a negative input end coupled to the output end OUTOTA of the gain stage 400. The amplifier AMP2 comprises a positive input end coupled to ground, a negative input end coupled to an output end of the amplifier AMP1, and an output end coupled to the output end of the amplifier AMP1. The amplifier AMP3 comprises a positive input end coupled to ground, a negative input end coupled to the output end of the amplifier AMP1 and an output end coupled to the node G. The amplifier AMP4 comprises a positive input end coupled to the power VDD, a negative input end coupled to the node G and an output end coupled to the node G. In brief, the amplifier AMP1 and the amplifier AMP3 adopts open-loop design for avoiding a dual-loop is formed in the voltage regulator 40 and preventing the design of the voltage regulator from being complex. The amplifier AMP2 and the amplifier AMP4 adopt close-loop design as loadings of the amplifier AM1 and the amplifier AMP3, respectively, for achieving the low-output-impedance feature of the low-output-impedance non-inverting amplifier unit 408. In such a condition, the gain between the output end OUTOTA and the node G can be expressed as:

$$gm1 \times \frac{1}{gm2} \times gm3 \times \frac{1}{gm4}$$

Since both the amplifier AMP1 and the amplifier AMP3 are non-inverting open-loop, the relationship between the output end OUTOTA and the node G remains non-inverting (i.e. the relationship between the output end OUTOTA and the output end OUT remains inverting), the voltage regulator 40 can use miller compensation module 406 (i.e. the miller compensation) for adjusting bandwidth of the voltage regulator 40 to improve the stability of the voltage regulator 40.

Via adding the low-output-impedance non-inverting amplifier unit 408 between the gain stage 400 and the output stage 404 as a buffer, the high output impedance of the output end OUTOTA of the gain stage 400 is not directly coupled to the parasitic capacitor $C_{GD}$ of the P-type transistor MPOS in the output stage 404. Furthermore, since the parasitic capacitor $C_{GD}$ changes to be coupled to the low-output-impedance non-inverting amplifier unit 408, the effect generated by the parasitic capacitor $C_{GD}$ to the output end OUTOTA can be reduced. Above advantages also can be acquired from changes of parasitic zeros Z1, Z2 of the voltage regulator 40. After adding the low-output-impedance non-inverting amplifier unit 408, the parasitic zeros Z1, Z2 can be expressed as:

$$Z1 \cong -\frac{gm_{MNO6}}{C_X}, \quad Z2 \cong \frac{gm_{MPOS}C_X}{C_{OTA}C_M + C_{GD}C_X}$$

Wherein, $C_X$ is a parasitic capacitance of the node X, $$\frac{1}{gm_{MNO6}}$$

is an equivalent resistance of the node X, $gm_{MPOS}$ is a trans-conductance of the P-type transistor MPOS, $C_{GD}$ is a parasitic capacitor from the gate to the drain of the P-type transistor MPOS and $C_{OTA}$ is an output impedance of the gain stage 400. According to the formula of the parasitic zero Z2, the parasitic zero Z2 is moved to higher frequency range after adding the low-output-impedance non-inverting amplifier unit 408. The gain of the voltage regulator 40 is raised to the higher frequency range, such that the design difficulty of the voltage regulator 40 is eased and the stability of the voltage regulator 40 is increased.

On the other hand, the low-output-impedance non-inverting amplifier unit 408 also can ease the effect generated due to the noise of the power VDD. Please refer to FIG. 4, noise A transmits noise B to the node G through the amplifier AMP4 when the noise A is generated in the power VDD. The noise B partly neutralizes the noise A in the voltage $V_{SG}$ of the P-type transistor MPOS. The power supply rejection ratio of the voltage regulator 40 is increased, therefore. The noise A also transmits noise C to the node G through the amplifiers AMP1, AMP3, however. Since a relationship between the noise B and the noise C is inverting, the noise C and the noise B cancel each other and the effect of neutralizing the noise A is decreased. Moreover, a high frequency part of the noise A also transmits noise D to the output end OUT through a parasitic capacitor $C_{SD}$ and a bandwidth of the power supply rejection ratio of the voltage regulator 40 cannot be improved due to the noise D. Thus, the present application may further add a high-frequency gain unit in the compensation module 40 for eliminating the noise C and the noise D in the voltage regulator 40.

Figure 5:
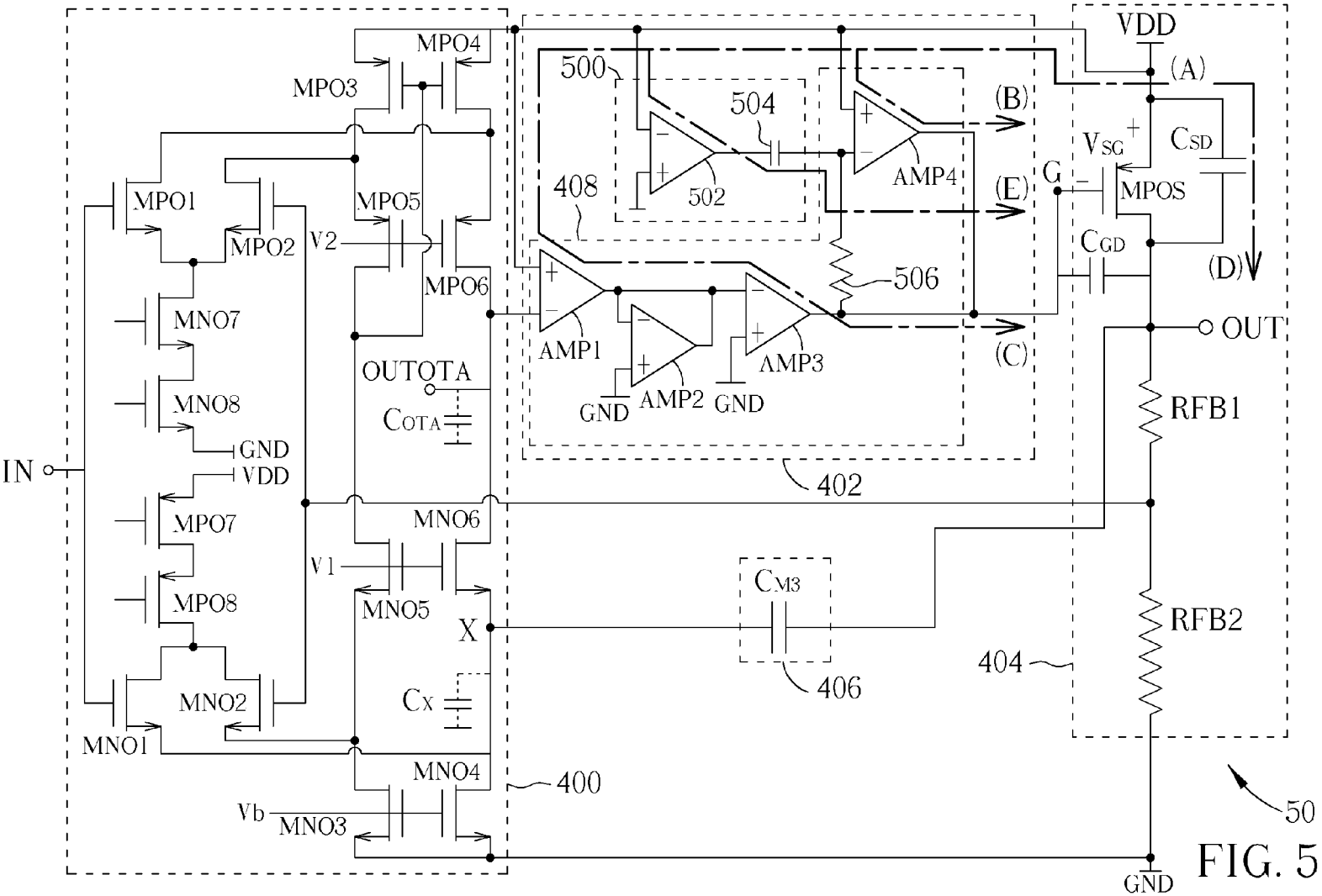
FIG. 5 is a schematic diagram of a voltage regulator according to another embodiment of the present invention.

Please refer to FIG. 5, which is a schematic diagram of a voltage regulator 50 according to an embodiment of the present invention. The voltage regulator 50 is similar to the voltage regulator 40 shown in FIG. 4, thus the signals and the components with the similar functions use the same symbols. Different from the voltage regulator 40, the voltage regulator 50 adds a high-frequency gain unit 500 to increase the bandwidth of the power supply rejection ratio of the voltage regulator 50. The high-frequency gain unit 500 comprises an amplifier 502 with a trans-conductance gm5, a compensation capacitor 504 and a compensation resistor 506. The amplifier 502 comprises a positive input end coupled to ground, a negative input end coupled to the power VDD and an output end coupled to the compensation capacitor 504. The compensation capacitor 504 is coupled to the negative input end of the amplifier AMP4 and the compensation resistor 506 is coupled between the output end of the amplifier AMP3 and the negative input end of the amplifier AMP4. Through the high-frequency gain unit 500, the noise A of the power VDD generates noise E with the same phase of the noise B. The transmission formula of the noise A transmits the noise E through the high-frequency gain unit 500 can be expressed as:

$$\frac{V_G}{VDD}(s) = \text{Gain}_{DC} \times \frac{\left(1 - \frac{s}{Z_{hf1}}\right)}{\left(1 - \frac{s}{1 - P_{hf1}}\right)\left(1 - \frac{s}{1 - P_{hf2}}\right)}$$

Figure 6:
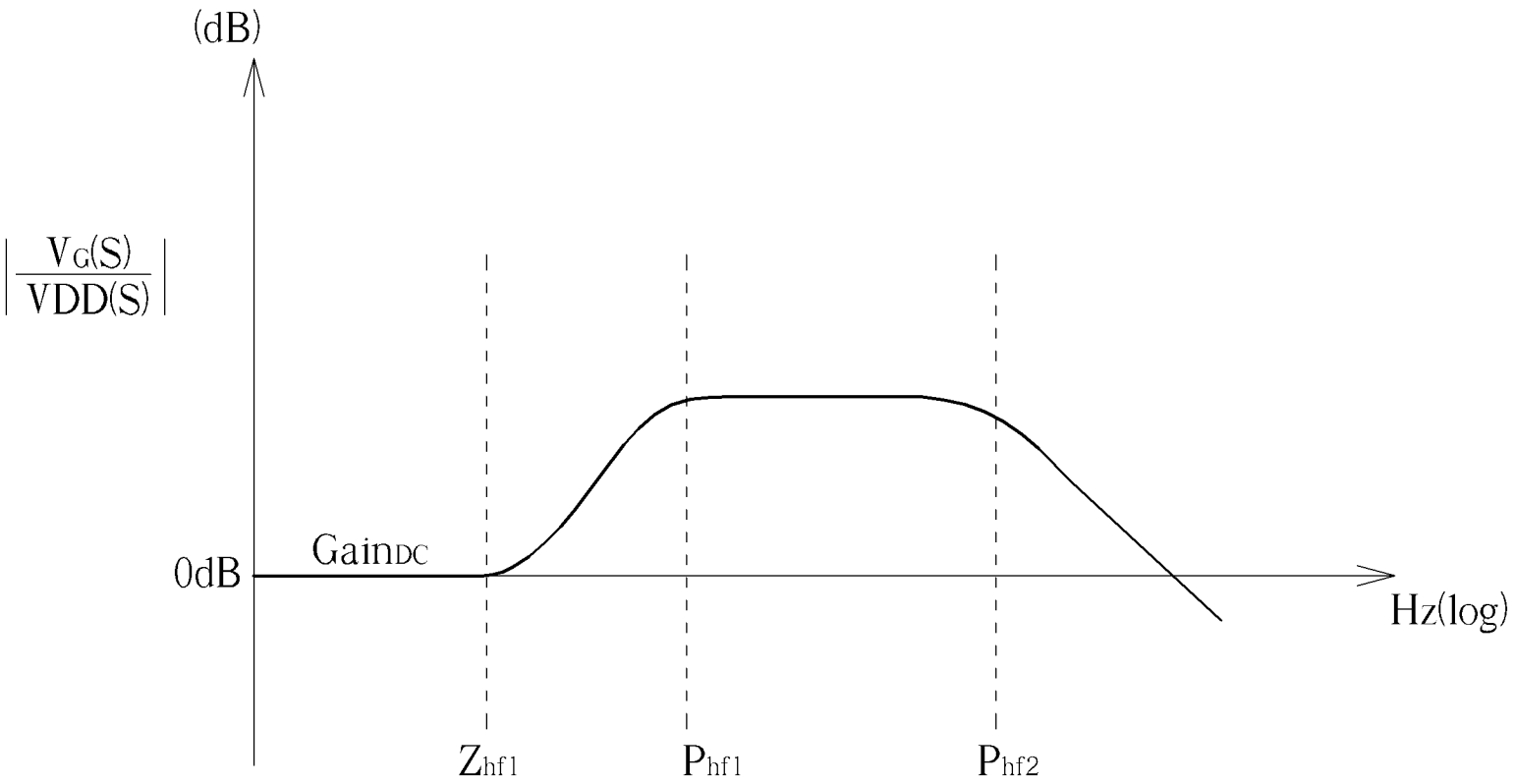
FIG. 6 is a gain-frequency characteristic diagram of a high-frequency gain unit in the voltage regulator shown in FIG. 5.

-continued $$\begin{cases} \text{Gain}_{DC} = \dfrac{gm4 \times r_{o,G}}{1 + gm4 \times r_{o,G}} \\ Z_{hf1} \cong -\dfrac{1}{RZ \times [CZ \times (gm5 \times r_{o,502})]} \\ P_{hf1} = -\dfrac{1}{r_{o,502} \times [C_{502} + CZ]} \\ P_{hf2} \cong -\dfrac{1}{RZ \times C_G} \end{cases}$$

wherein, $r_{O,G}$ is an equivalent resistance of the node G, $r_{O,502}$ is an output resistance of the amplifier 502, RZ is a resistance of the compensation resistor 506, CZ is a capacitance of the compensation capacitor 504, $C_{502}$ is an equivalent capacitance located on the output end of the amplifier 502 and $C_G$ is an equivalent capacitance configured on the node G. According to the above formula, a gain-frequency characteristic diagram of the transmission formula of the noise A transmits the noise E through the high-frequency gain unit 500 can be acquired as shown in FIG. 6. In FIG. 6, a baseband gain GainDC of the noise A generates the noise E via the high-frequency gain unit 500 is close to 1. The gain of the high-frequency gain unit 500 rises when the frequency approaches the zero $Z_{hf1}$, and then the high-frequency gain unit 500 generates a signal which is inverting to the noise C, D to the output end OUT for cancelling the negative effect generated by the noise C, D. That is, via designing the zero $Z_{hf1}$, poles $P_{hf1}$, $P_{hf2}$ (e.g. adjusting the resistance RZ and the capacitance CZ), appropriately, the voltage regulator 50 can eliminate the noise C and the noise D through the high-frequency gain unit 500. Please note that, since the capacitance CZ is magnified by gm5×$r_{o,502}$ in the formula of the zero $Z_{hf1}$, the voltage regulator 50 may move the zero $Z_{hf1}$ to low-frequency range via adjusting gm5×$r_{o,502}$ instead of increasing the capacitance CZ, for avoiding increasing the layout area of the voltage regulator 50.

Figure 7:
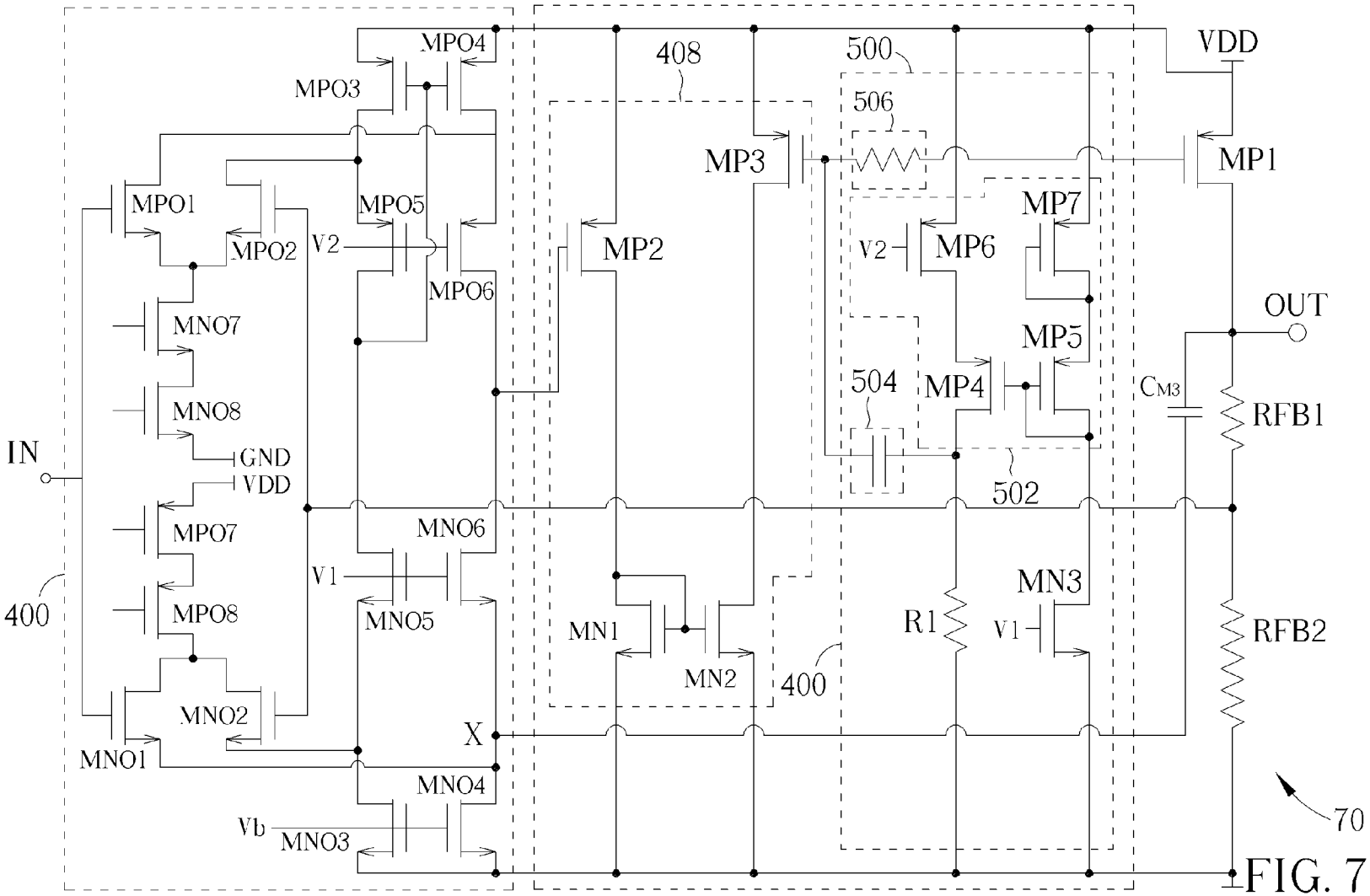
FIG. 7 is a schematic diagram of a realization of the voltage regulator shown in FIG. 5.

Please refer to FIG. 7, which is a schematic diagram of a realization of the voltage regulator 50 shown in FIG. 5. As shown in FIG. 7, the low-output-impedance unit 408 comprises P-type transistors MP2, MP3 and N-type transistors MN1, MN2. The amplifier 502 is realized by P-type transistors MP4-MP7, an N-type transistor MN3 and a resistor R1. The operation methods between the P-type transistors MP2-MP7, N-type transistors MN1-MN3 and the resistor R1 should be known to those with ordinary skill in the art. In short, the amplifiers AMP1-AMP4 are realized by the P-type transistor MP2, the N-type transistor MN1, the N-type transistor MN2 and the P-type transistor MP3, respectively, and the trans-conductance gm5 of the amplifier 502 is realized by the P-type transistor MP4. In this embodiment, the trans-conductance gm1 of the amplifier AMP1 equals the trans-conductance gm4 of the amplifier AMP4 and the trans-conductance gm2 of the amplifier AMP2 equals the trans-conductance gm3 of the amplifier AMP3 for simplifying the design of the voltage regulator 50. That is, the P-type transistors MP2, MP3 and the N-type transistors MN1, MN2 form a current mirror with 1:1 ratio. The voltage regulator 50 shown in FIG. 7 utilizes a minimum number of components to realize low-output-impedance non-inverting amplifier unit 408 and the amplifier 502, for minimizing the layout area of the voltage regulator and avoiding unnecessary circuitry becoming new noise sources. The concept of the voltage regulator 50 shown in FIG. 7 eliminates the effects generated by the parasitic zeros and increases the power supply rejection ratio can be known by referring to the above, and is not narrated herein for brevity.

Please note that, the above embodiments add the amplifier with low-output-impedance feature between the gain stage and the output stage of the voltage regulator as a buffer for preventing the parasitic zeros from raising the gain of the voltage regulator in high frequency range, so as to simplify the design of the voltage regulator and increase the stability of the voltage regulator. Since the amplifier coupled between the gain stage and the output stage of the voltage regulator has the non-inverting gain feature, the voltage regulator still can use miller compensation method to perform the frequency compensation. The bandwidth of voltage regulator can be effectively adjusted without significantly increasing the chip area, therefore. On the other hand, the above embodiments utilize high-frequency gain unit to limit the effects of the noise in the high-frequency range. According to different applications, those with ordinary skill in the art may observe appropriate alternations and modifications. For example, the structures and the coupling relationships of the gain stage 400, the output stage 404 and the miller compensation module 406 of the voltage regulators 40, 50 can be implemented by other methods and are not limited to the structures shown in FIG. 4 and FIG. 5.

To sum up, the voltage regulators of the above embodiments utilize the low-output-impedance non-inverting amplifier unit to avoid the parasitic zeros affecting the stability of the voltage regulator. Moreover, the voltage regulators of the above embodiments eliminate the high-frequency noise coupling to the output end via adding the high-frequency gain unit. The stability and the power supply rejection ratio disclosed in the present application can be effectively improved, therefore.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A compensation module for a voltage regulation device comprising a gain stage, an output stage and a miller compensation module, the compensation module comprising:

a low-output-impedance non-inverting amplifier unit coupled to a gain output of the gain stage and an output-stage input of the output stage; and a high-frequency gain unit, coupled between a power end of the voltage regulation device and the low-output-impedance non-inverting amplifier unit for outputting an high-frequency noise suppression signal to the low-output-impedance non-inverting amplifier unit according to a high-frequency noise of the power end, to decrease high-frequency noise of the output stage via the low-output-impedance non-inverting amplifier unit.

2. The compensation module of claim 1, wherein a compensation method of the gain stage, the output stage and the miller compensation module is cascode miller compensation.

3. The compensation module of claim 1, wherein the low-output-impedance non-inverting amplifier unit comprises:

a first amplifier, comprising a first positive input end coupled to the power end of the voltage regulation device, a first negative input end coupled to amplifying output end of the gain stage, and a first output end;

a second amplifier, comprising a second positive input end coupled to a ground end of the voltage regulation device, a second negative input end coupled to first output end, and a second output end coupled to the first output end;

a third amplifier, comprising a third positive input end coupled to the ground end, a third negative input end coupled to first output end, and a third output end; and a fourth amplifier, comprising a fourth positive input end coupled to the power end, a fourth negative input end coupled to third output, and a fourth output end coupled to the third output end and the output-stage input end of the output stage.

4. The compensation module of claim 3, wherein the first amplifier is a first P-type transistor having a source as the first positive input end, a gate as the first negative input end and a drain as the first output end;

the second amplifier is a first N-type transistor having a source as the second positive input end, a gate as the second negative input end and a drain as the second output end;

the third amplifier is a second N-type transistor having a source as the third positive input end, a gate as the second negative input end and a drain as the third output end; and the fourth amplifier is a second P-type transistor having a source as the fourth positive input end, a gate as the fourth negative input end and a drain as the fourth output end.

5. The compensation module of claim 3, wherein the high-frequency gain unit comprising:

a fifth amplifier, comprising a fifth positive input end coupled to ground, a fifth negative input end coupled to the power end and a fifth output end;

a compensation capacitor, coupled between the fifth output end and the fourth negative input end; and a compensation resistor, coupled between the third output end and the fourth negative input end.

6. A voltage regulation device, comprising:

a gain stage;

an output stage;

a miller compensation module, coupled between an output-stage output end of the output stage and the gain stage; and a compensation module, comprising:

a low-output-impedance non-inverting amplifier unit coupled to a gain output of the gain stage and an output-stage input of the output stage; and a high-frequency gain unit, coupled between a power end of the voltage regulation device and the low-output-impedance non-inverting amplifier unit for outputting an high-frequency noise suppression signal to the low-output-impedance non-inverting amplifier unit according to a high-frequency noise of the power end, to decrease high-frequency noise of the output stage via the low-output-impedance non-inverting amplifier unit.

7. The voltage regulation device of claim 6, wherein a compensation method of the gain stage, the output stage and the miller compensation module is cascode miller compensation.

8. The voltage regulation device of claim 6, wherein the low-output-impedance non-inverting amplifier unit comprises:

a first amplifier, comprising a first positive input end coupled to the power end of the voltage regulation device, a first negative input end coupled to amplifying output end of the gain stage, and a first output end;

a second amplifier, comprising a second positive input end coupled to a ground end of the voltage regulation device, a second negative input end coupled to first output end, and a second output end coupled to the first output end;

a third amplifier, comprising a third positive input end coupled to the ground end, a third negative input end coupled to first output end, and a third output end; and a fourth amplifier, comprising a fourth positive input end coupled to the power end, a fourth negative input end coupled to third output, and a fourth output end coupled to the third output end and the output-stage input end of the output stage.

9. The voltage regulation device of claim 8, wherein the first amplifier is a first P-type transistor having a source as the first positive input end, a gate as the first negative input end and a drain as the first output end;

the second amplifier is a first N-type transistor having a source as the second positive input end, a gate as the second negative input end and a drain as the second output end;

the third amplifier is a second N-type transistor having a source as the third positive input end, a gate as the second negative input end and a drain as the third output end; and the fourth amplifier is a second P-type transistor having a source as the fourth positive input end, a gate as the fourth negative input end and a drain as the fourth output end.

10. The voltage regulation device of claim 8, wherein the high-frequency gain unit comprising:

a fifth amplifier, comprising a fifth positive input end coupled to ground, a fifth negative input end coupled to the power end and a fifth output end;

a compensation capacitor, coupled between the fifth output end and the fourth negative input end; and a compensation resistor, coupled between the third output end and the fourth negative input end.

11. A compensation module for a voltage regulation device comprising a gain stage, an output stage and a miller compensation module, the compensation module comprising:

a low-output-impedance non-inverting amplifier unit coupled to a gain output of the gain stage and an output-stage input of the output stage;

wherein the low-output-impedance non-inverting amplifier unit comprises:

a first amplifier, comprising a first positive input end coupled to a power end of the voltage regulation device, a first negative input end coupled to amplifying output end of the gain stage, and a first output end;

a second amplifier, comprising a second positive input end coupled to a ground end of the voltage regulation device, a second negative input end coupled to first output end, and a second output end coupled to the first output end;

a third amplifier, comprising a third positive input end coupled to the ground end, a third negative input end coupled to first output end, and a third output end; and a fourth amplifier, comprising a fourth positive input end coupled to the power end, a fourth negative input end coupled to third output, and a fourth output end coupled to the third output end and the output-stage input end of the output stage.

12. The compensation module of claim 11, wherein a compensation method of the gain stage, the output stage and the miller compensation module is cascode miller compensation.

13. The compensation module of claim 11, further comprising:

a high-frequency gain unit, coupled between the power end of the voltage regulation device and the low-output-impedance non-inverting amplifier unit for outputting an high-frequency noise suppression signal to the low-output-impedance non-inverting amplifier unit according to a high-frequency noise of the power end, to decrease high-frequency noise of the output stage via the low-output-impedance non-inverting amplifier unit.

14. The compensation module of claim 11, wherein the first amplifier is a first P-type transistor having a source as the first positive input end, a gate as the first negative input end and a drain as the first output end;

the second amplifier is a first N-type transistor having a source as the second positive input end, a gate as the second negative input end and a drain as the second output end;

the third amplifier is a second N-type transistor having a source as the third positive input end, a gate as the second negative input end and a drain as the third output end; and the fourth amplifier is a second P-type transistor having a source as the fourth positive input end, a gate as the fourth negative input end and a drain as the fourth output end.

15. The compensation module of claim 11, further comprising a high-frequency gain unit comprising:

a fifth amplifier, comprising a fifth positive input end coupled to ground, a fifth negative input end coupled to the power end and a fifth output end;

a compensation capacitor, coupled between the fifth output end and the fourth negative input end; and a compensation resistor, coupled between the third output end and the fourth negative input end.

* * * * *